US006511275B2

(12) United States Patent
Ray

(10) Patent No.: US 6,511,275 B2
(45) Date of Patent: Jan. 28, 2003

(54) DRYWALL PANEL CARRIER ATTACHABLE TO LIFT PLATFORM

(76) Inventor: Charles T. Ray, 130 Lark La., Harvest, AL (US) 35749

( * ) Notice: Subject to any disclaimer, the term of this patent is extended or adjusted under 35 U.S.C. 154(b) by 22 days.

(21) Appl. No.: 09/842,584

(22) Filed: Apr. 25, 2001

(65) Prior Publication Data

US 2002/0159863 A1 Oct. 31, 2002

(51) Int. Cl.[7] ..... E04G 21/14
(52) U.S. Cl. ..... 414/11; 211/50; 182/141
(58) Field of Search ..... 414/11; 211/41.1, 211/41.14, 41.15; 182/141, 113

(56) References Cited

U.S. PATENT DOCUMENTS 3,706,105 A * 12/1972 Nicholas et al. ..... 211/88.01
3,785,602 A * 1/1974 Juculano ..... 182/113
4,061,257 A * 12/1977 St. Clair ..... 211/70.2
4,741,505 A * 5/1988 Anderson ..... 248/357

OTHER PUBLICATIONS

Echternacht, James E., Carriage for a Construction Panel, Aug. 23, 2001, Pub. No.: US 2001/0016156 A1.*
Preusser et. al., Support Structure for Suspending a Work Surface Below a Girder, Nov. 8, 2001, Pub. No.: US 2001/0037914 A1.*

* cited by examiner

*Primary Examiner*—Kathy Matecki
*Assistant Examiner*—Michael J. Kwon
(74) *Attorney, Agent, or Firm*—Joseph H. Beumer

(57) ABSTRACT

Apparatus for lifting and transporting drywall panels on a lift platform has a pair of panel-supporting legs of square metal tubing attachable to side rails of a lift platform. Each of the legs is connected to the rails by an upper clamp at the top of the leg and a lower clamp at a middle location. A panel-receiving U-shaped channel is located on the opposite side of the leg, away from the rails. The lower clamp has a standoff member included in its connection to the leg, which serves to project the bottom of the legs outward at an angle. Rollers at the top and bottom of the legs provide low-friction rolling contact for weight bearing surfaces, and other rollers are placed to keep panels away from contacting the legs or other surfaces.

13 Claims, 4 Drawing Sheets

DRYWALL PANEL CARRIER ATTACHABLE TO LIFT PLATFORM

FIELD OF THE INVENTION

This invention relates to handling of building panels at construction sites and more particularly to equipment for transporting and lifting of panels to an elevated position convenient to installers.

BACKGROUND OF THE INVENTION

Handling of building panels such as drywall or "Sheetrock" panels has presented difficulties, especially for large panels being installed in commercial buildings at heights above a first floor level. Drywall panels for such applications may be as large as four feet by twelve feet and weigh one hundred pounds or more. It is readily apparent that any improvements in equipment and procedures for lifting such panels to a required elevated location would be welcomed by installers.

Use of scissors-type lift machines has become a common practice at commercial building sites. These devices have sets of paired extendable arms mounted on a wheeled and powered chassis and a work platform supported by the arms. For safety reasons the platforms include horizontal rails around their outer edges supported by upright posts. The rail structure generally includes an upper rail some three feet above the platform floor and a lower rail halfway between the floor and upper rail. The rails generally take the form of square metal tubing. Lift platforms may be eight feet by three feet and provide space for two to three workmen. Machines of this type are exemplified by U.S. Pat. No. 6,158,550, issued Dec. 12, 2000 to Arnoldy, which patent is hereby expressly incorporated by reference.

Attempts have been made to use existing lift devices for lifting large panels along with the workmen to an elevated working level, but various disadvantages are presented. If the panel is longer than the platform it could only be carried on top of or outside of the rails, which would be difficult or even unsafe to the workers. Also the panel might end up in a position requiring awkward moves by the workman to place the panel in final location. In addition, operations such as sliding a panel over a platform or rail might result in damage to the panel.

SUMMARY OF THE INVENTION

The present invention is directed to apparatus for lifting and transporting panels of material such as drywall to a desired location at a construction site. The apparatus comprises a pair of panel-receiving legs attachable to horizontal side rails of a lift platform, with the legs when attached extending generally in a vertical direction. Square metal tubing is a suitable material for making the legs.

Each of the legs has a top, bottom and midpoint along its length, an inside surface facing the platform from the outside when installed and an outside surface facing the opposite direction. Clamps for making connection to upper and lower rails of a lift platform may be removably attached to the rail on the inside of the legs, an upper clamp at the top of the leg and a lower clamp at a midpoint. The legs have a panel-receiving channel provided at the bottom of the leg and on the outside thereof. A low friction contact member at base of the channel is used to obtain enhanced rolling or sliding movement of panels, and a horizontal guide serves to return the panels in position.

Low friction contact surfaces may also be provided at various other locations so as to keep the panels from being slid over the surfaces which present higher friction. This feature may be implemented in the form of rollers located at the base of the channel at the top of the leg, at a side or the channel above the base roller and at a midpoint of the leg. In each case the roller is placed so that its circumference extends to provide space away from surfaces of other structural members.

To provide for easier handling of panels and to keep them from falling out of the channel, the leg may be adapted for being inclined outward at the bottom at an acute angle such as ten to fifteen degrees from the vertical. This result may be obtained by mounting the lower clamp on a standoff member at a suitable length whereby the bottom of the leg is projected outward.

Variations in the distance between upper and lower rails of different platform lifts may be accommodated by pivotally mounting the lower clamp support on the leg and by providing a series of vertically separated holes through the leg to allow for adjustment by insertion of a pin in a selected mounting hole. Use of the apparatus for narrower panels having a width such as two foot may be enabled by placement of the channel structure at a midpoint of the legs. For this purpose this component may be removably mounted for attachment at the midpoint as well as at the bottom of the leg.

Another desirable feature of the invention is to provide a braking mechanism for the roller at the base of the channel to prevent unintended rolling or sliding when the platform is moved. Locking of the load-bearing wheel at the base of the channel, as by insertion of a pin, may be employed.

Apparatus embodying the invention provides important advantages, particularly in the ease and convenience of moving large and heavy panels to a position which is optimum for further movement into the final location for installation. Safety and productivity of panel installers are thereby enhanced, and damage to panels is reduced.

It is accordingly an object of this invention to provide a panel-carrying attachment for lift platforms.

Another object is to provide a panel-carrying attachment having low friction, load-bearing surfaces enabling ease of loading.

DESCRIPTION OF THE PREFERRED EMBODIMENT

Figures 1, 4:
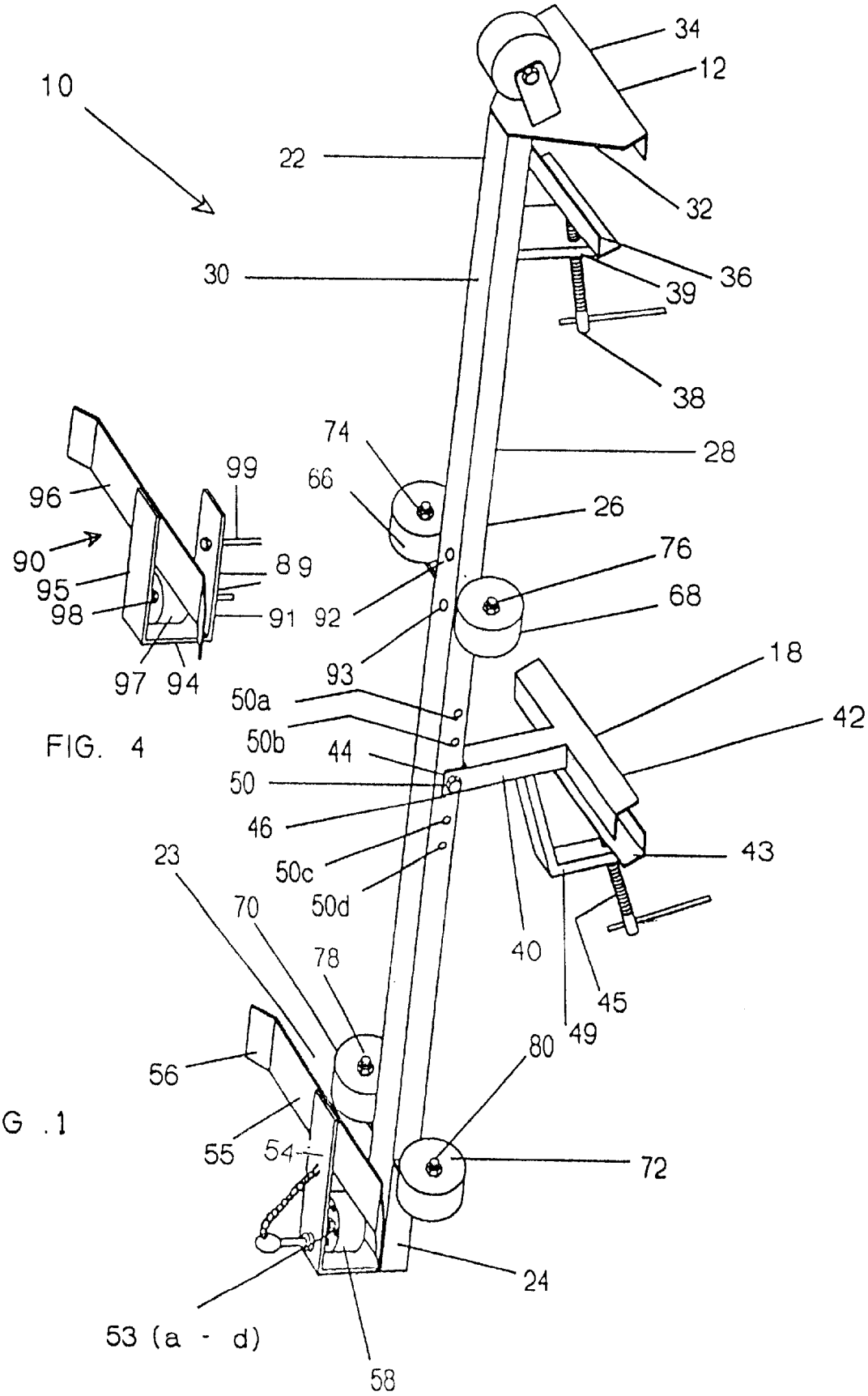
FIG. 1 is a perspective view of a panel-supporting leg embodying the invention.
FIG. 4 is a perspective view of a panel-receiving assembly removably attachable for use with narrow panels.

Referring to FIG. 1 of the drawings there is shown a panel-supporting leg 10 which is a component of a panel-lifting and carrying apparatus embodying the invention. Two such legs are required at spaced-apart locations along the length of a lift platform for effective support of panels. Each of the legs has a pair of clamps located on the inside of the leg, upper clamp 12 attachable to an upper horizontal rail 14 of a lift platform 16 and a lower clamp 18 attachable to a lower rail 20 of the platform.

Leg 10 preferably takes the form of a straight piece of square metal tube which may have a width of one inch and a length of three feet. The leg has a top end 22, a bottom end 24 and a middle area 26 between the ends. Flat side 28 of the leg is positioned on the inside of the tube facing the rail and opposing flat side 30 faces outward away from the rail.

Upper jaw clamp 12 is rigidly connected to plate 32, which in turn is joined to top end 22 of the leg and which extends inward to flat side 28 of the leg. Upper jaw 34 of this clamp comprises a segment of L-shaped angle iron adapted to fit over the inside upper corner of rail 14. Lower jaw 36 of this clamp has a similar structure to the upper jaw and is supported by adjustable screw 38 mounted on stud 39 connected to the leg.

Lower clamp 18 is also located on the inside of the leg and is arranged to come into clamping contact with lower rail 20. Clamp 18 has an upper jaw 42 and lowern jaw 43 supported by an adjustable screw 45 mounted on support arm 49 which is connected to standoff arm 40. This clamp in the embodiment shown is connected to the leg at a middle portion 26, and may be varied to compensate for differences in rail placement on different platforms, as is described below. A standoff arm 40, disposed between upper jaw 42 of clamp 18 and attachment bracket 44 causes the bottom end of the leg to be projected outward away from the platform at a selected acute angle sssuch as 10 to 15 degrees from vertical. This extent of slanting enables easier grasping and handling of the panel, particularly when the panel is removed by being lifted in a direction backward over the workmens' heads. Capability for movement of clamp 18 over a narrow range is provided by pivotally mounting of bracket 44 around pin 46 through hole 50. A series of vertically spaced apart alternate holes 50*a* to 50*d* are provided to allow for mounting at varying heights.

Figure 2:
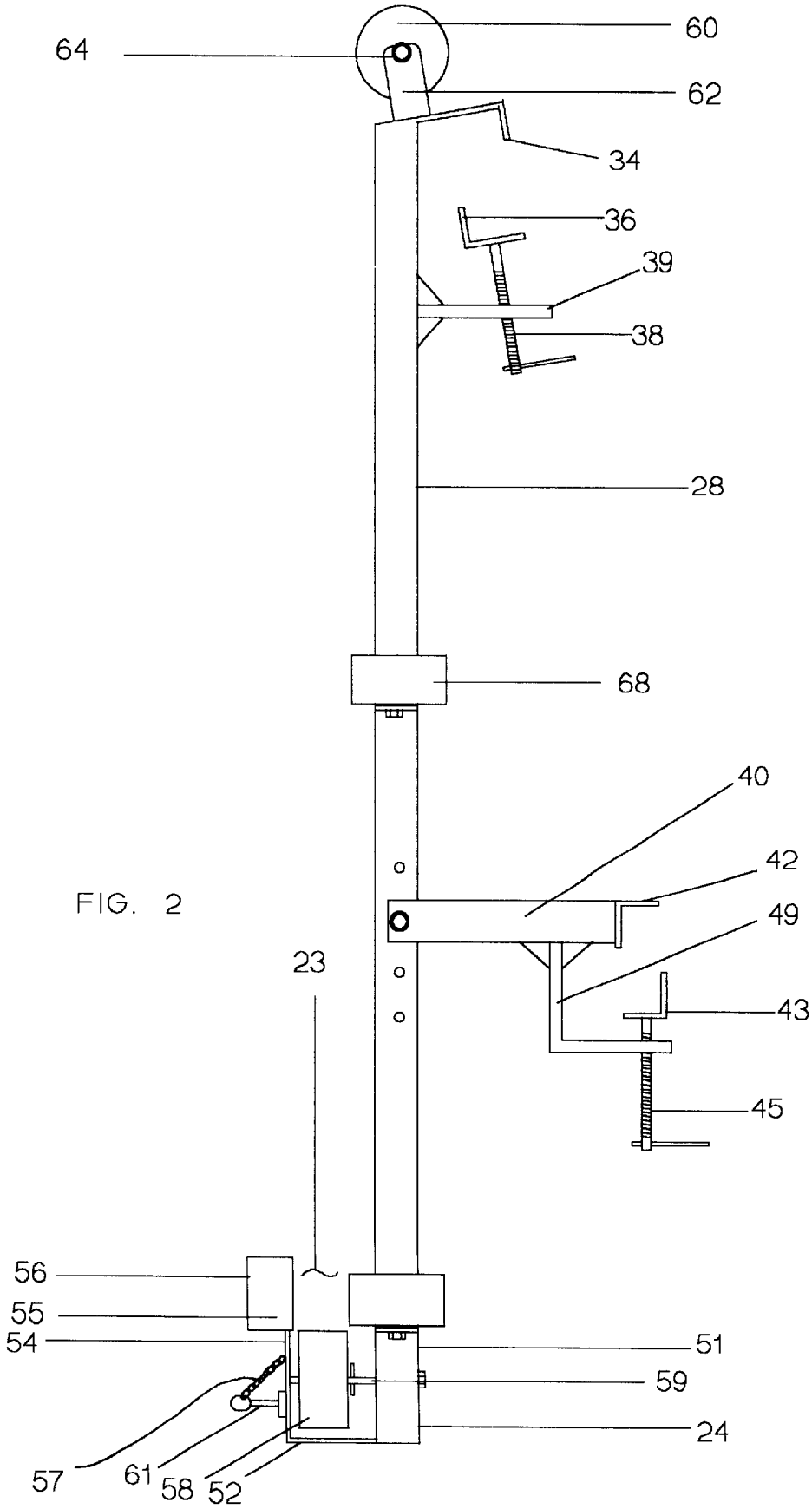
FIG. 2 is an elevational view thereof taken from a side.

A panel-receiving channel 23 (FIG. 2) is provided at the bottom end 24 of the leg and adjacent to outside flat side 30. The channel may be formed by an end portion 51 of the leg, a horizontally extending bottom plate 52 and a short vertically extending plate member 54, which may be a bent over extension of plate 52. A horizontally extending guide 55 in the form of a plate attached to vertical plate 54 and having end portions 56 bent outward is provided to restrain panels from moving laterally out of position. A roller 58 is mounted on axle 59 extending from leg portion 51 to vertical plate 54, providing an axis of rotation perpendicular to the leg. The weight of the panel being carried rests fully on the load-bearing roller 58 so that a very low extent of friction is encountered when the panel is slid into position.

Figure 3:
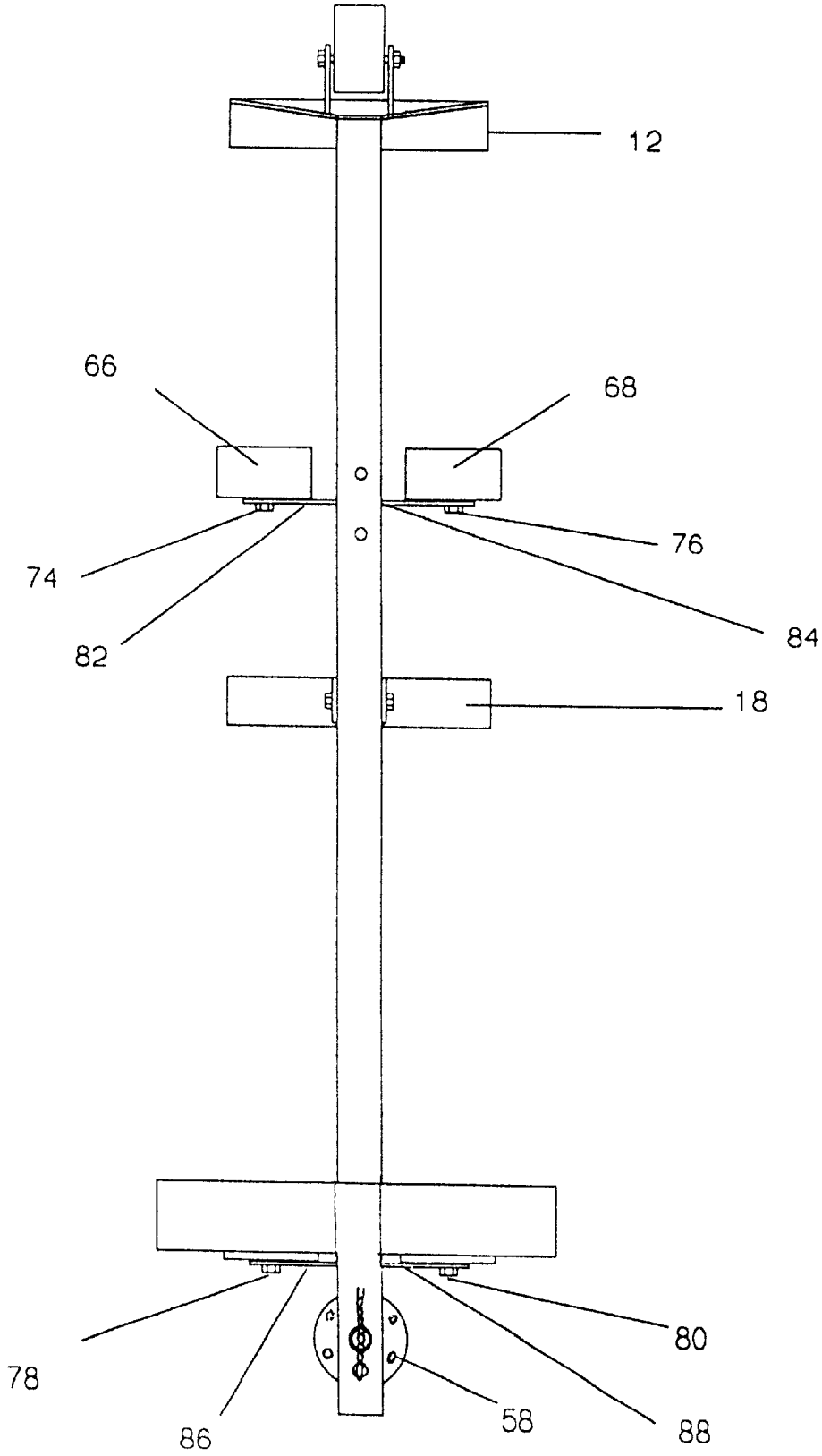
FIG. 3 is an elevational view taken from the outside of the leg when installed.
Figure 5:
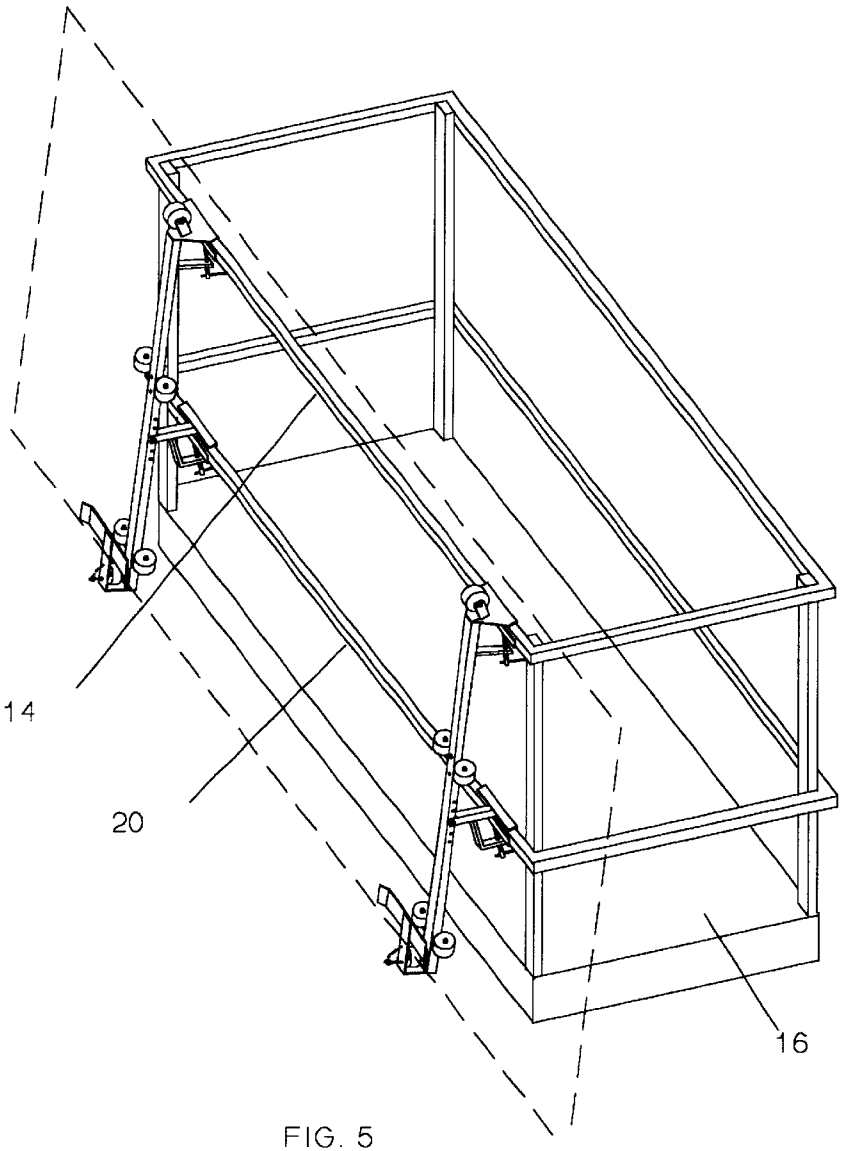
FIG. 5 is a perspective view showing a pair of legs installed on rails of a lift platform.

In addition to roller 58 located at the base of the channel other rollers may be provided at the top end of the leg and at side positions to facilitate handling of panels and to restrain panels from coming into contact with other structural elements. Roller 60 is placed at the top end 22 of the leg, mounted on U-shaped bracket 62 on axle 64 which is generally perpendicular to the leg. This roller facilitates removal of the panel when being raised upward for unloading. Placement of the roller with its circumference slightly outside of side 30 of the leg keeps the panel from coming into contact with the leg. Sets of rollers 66, 68 and 70, 72 are provided on opposing sides of the middle 26 and bottom 24 of the leg, respectively. These rollers are mounted on axles 74, 76 and 78, 80 parallel to the leg and supported by plates 82, 84 and 86, 88 (FIG. 3) perpendicular to the leg. Placement of these rollers with their circumference spaced outside of the level of leg avoids contact of panels with the legs and facilitates movement of panels into and out of position.

It is noted that only one of the rollers of sets 66, 68 and 70, 72 would be required in operation, that one being the roller which first comes into contact with a panel being loaded, that is the roller on the side facing the panel in the direction from which the panel is moving. Placement of rollers on both sides is preferred, however, to enable any leg to receive panels from both directions.

Ball-bearing rollers with wheels made of heavy plastic such as are used in roller skates may be used, with suitable dimensions being a diameter of two inches and a width of one and one-fourth inches.

FIG. 1 shows a safety feature in the form of a roller-locking mechanism incorporated in apparatus of this invention. To prevent panels from sliding off of the channels in which they are supported, particularly when the lift platform is being moved after loading, a locking pin 61 may be inserted into a hole 53*a*–53*d* in the bottom roller 58, the pin also passing through a hole in plate 54. To avoid loss of pin 61 it may be secured to the plate by means such as a chain 57.

FIG. 4 shows an embodiment wherein a channel assembly 90 is provided for removable attachment to leg 10 at an intermediate position adjacent to rollers 66,68, The assembly is formed into a U-shaped bracket 91, including a vertical segment 89 attachable to leg 10 at holes 92, 93, a base segment 94 and an outer vertical segment 95 connected to guide 96 at the upper end thereof Roller 97 mounted on axle 98 is positioned in the same manner as for roller 58. Connection of the assembly to leg 10 is enabled by bolt 99, which extends through hole 92. Axle 98 which supports yhe roller may also extend slightly into hole 93. This removable assembly could also be used at the bottom of the leg by making slight modifications to the leg. This assembly provides for convenient handling of narrow panels having a width such asa two feet, which might otherwise come into direct contact with surfaces of the legs.

In order to prevent overloading of the panel lifting apparatus, as might occur if too many heavy panels were placed on the legs at one time, the width of panel-receiving channels 23 is preferably limited to a distance between rollers 70, 72 and guides 55 of about one to one and one-half inch. This would allow room for only one panel, with enough slack provide to enable free movement. Also, after one panel is loaded on the supporting legs, it would be difficult to load a second one because rotation of the rollers when the second panel is being slid into position would cause the first panel to be moved outward.

In operation of the apparatus of this invention for installing wall panels, it is preferred to bring the lift platform, when loaded, into a position such that the legs and supported panel are located on a side rail away from the wall. This allows the opposite side of the platform to be brought closer to the wall and minimizes the distance over which the installers would need to reach. Removal of the panel from the legs and into position on the wall also proceeds more smoothly than if the legs were on a side adjacent the wall.

Although the invention is described with reference to drywall panels, it is to be understood that the panels may be comprised of other materials such as plywood and other wood-based compositions as well as polmeric materials such as poly-carbonates and glass.

The posts used for panel-supporting legs preferably may be metal tubes having a rectangular or square cross section but the invention includes posts in the form of shapes such as angle iron, beams, or the like.

It is to be understood that although the invention is described above in terms of specific embodiments, it is not so limited, but is limited only as defined in the approved claims.

What is claimed is:

1. Apparatus for supporting sheet material panels for being lifted on a lift platform having a plurality of straight, spaced-apart horizontal rails disposed around a periphery of and above a platform floor of a said lifting platform comprising:

a pair of panel-supporting legs attachable to said rails, each said leg comprising a rigid post having a top end, a bottom end, a middle portion, a first side and a second side;

each said leg at said top end having an upper clamp connected thereto and adapted for being attached to an upper one of said rails, said upper clamp extending from a first side of said post toward said rail when attached;

each said leg also having a lower clamp connected thereto at a said middle portion, said lower clamp extending from said first side of said post and adapted for attachment to a lower one of said rails;

each said leg also having a lower clamp connected thereto at a said middle portion, said lower clamp extending from said first side of said post and adapted for attachment to a lower one of said rails;

each said leg at said bottom end having support members defining a panel-receiving channel at said second side facing away from said rails;

whereby a panel may be placed on edge in said channels and supported for lifting;

said lower clamp is connected to said leg by means including a standoff member whereby said bottom end of said leg may be projected outward at a selected angle when installed.

2. The apparatus as defined in claim 1 wherein said support members defining said channel comprise a horizontally extending base plate connected to said bottom end of said post and a vertically extending plate connected to said base plate.

3. The apparatus as defined in claim 2 comprising a load-bearing member characterized by having a low-friction contact surface disposed across a said channel.

4. The apparatus as defined in claim 3 comprising a horizontally extending guide connected to said vertically extending plate and in a direction parallel to said rails when installed.

5. The apparatus as defined in claim 3 further comprising a roller mounted on each said post at said channel, the said roller mounted on an axle perpendicular to said post and aligned to provide load-bearing support of a panel and enabling rolling contact in a direction parallel to said rail.

6. The apparatus as defined in claim 4 wherein said lower clamp is pivotally mounted on said post.

7. The apparatus as defined in claim 6 wherein said lower clamp is mounted on a vertically movable connector whereby said clamp mount may be moved to a selected vertical position.

8. The apparatus as defined on claim 7 wherein said lower clamp mount comprises an outer metal tube portion adjustably connected to said post at a selected one of a plurality of vertically spaced levels in said post.

9. The apparatus as defined in claim 5 further comprising a roller mounted at the said top end of each post on an axle perpendicular to said post and having a surface of said roller disposed away from said post so as to keep a panel carried on the post from coming into contact with said post.

10. The apparatus as defined in claim 9 including additional rollers mounted at said bottom end and middle portion of each said post on axles parallel to said posts and having circumferential surfaces of said additional rollers spaced apart from outer surfaces at said posts whereby faces of a said panel are kept from coming into contact with said post.

11. The apparatus as defined in claim 10 wherein said additional rollers comprise a pair of rollers mounted on opposite sides of each said post at said bottom end and said middle portion.

12. The apparatus as defined in claim 5 wherein said panel-receiving channel comprises a removable assembly comprising a U-shaped support structure including a vertical plate attachable to said leg at an intermediate position, a base plate, an outer vertical plate and a roller mounted on an axle journalled in said vertical plates.

13. The apparatus as defined in claim 5 further comprising means for locking said roller.

* * * * *